US007102965B1

(12) United States Patent
Hagan, Jr.

(10) Patent No.: US 7,102,965 B1
(45) Date of Patent: Sep. 5, 2006

(54) RADIO ASSEMBLY

(76) Inventor: Daniel L. Hagan, Jr., 857 Lost Lake Trail, Oakland, MI (US) 48363

( * ) Notice: Subject to any disclaimer, the term of this patent is extended or adjusted under 35 U.S.C. 154(b) by 169 days.

(21) Appl. No.: 10/430,574

(22) Filed: May 6, 2003

(51) Int. Cl.
*H04H 9/00* (2006.01)

(52) U.S. Cl. ..... 369/7; 369/60.01

(58) Field of Classification Search ..... 369/6, 369/7, 60.01
See application file for complete search history.

(56) References Cited

U.S. PATENT DOCUMENTS 4,408,309 A * 10/1983 Kiesling et al. ..... 369/60.01
5,263,199 A * 11/1993 Barnes et al. ..... 369/7
5,345,430 A * 9/1994 Moe ..... 369/7
5,463,599 A * 10/1995 Yifrach et al. ..... 369/7
5,633,837 A * 5/1997 Gantt ..... 369/6

* cited by examiner

*Primary Examiner*—Paul W. Huber
(74) *Attorney, Agent, or Firm*—Law Offices of John Chupa and Associates, P.C.

(57) ABSTRACT

An assembly (40) which is disposed within a conventional radio (10) and a method (200) for replaying a real time audio signal (50). Particularly, the assembly (40) includes a memory assembly (56) which records a digitally converted analog signal (53), compresses the recorded signal in a digital signal processor (54), and allows a user (20) to selectively listen to up to sixty seconds of missed audio signal (53, 57) while obviating missing any of the real time audio signal (50) immediately following the missed audio signal (53, 57).

4 Claims, 3 Drawing Sheets

RADIO ASSEMBLY

FIELD OF THE INVENTION

The present invention generally relates to a radio assembly and, more particularly, a radio assembly having a memory and playback feature which allows a user to selectively replay a previously received and stored radio signal in a compressed playback mode in a convenient manner while obviating missing any following portions of a radio signal subsequent to the compressed playback function being selectively initiated.

BACKGROUND OF THE INVENTION

Automotive entertainment systems are conventionally capable of multiple modes of operation, such as and without limitation, AM/FM/satellite radio, Tape cassette play, MP-3 play, and/or CD-sourced play. Although, the abovementioned modes of play do desirably provide a user with desirable entertainment, each suffers from a substantially similar drawback.

For example and without limitation, the AM/FM/satellite radio (i.e., Amplitude Modulation, Frequency Modulation, and satellite radio) each is a different form of a steady stream broadcast-signal which is non-repeating. Therefore, if a listener of a respective one of these types of broadcast signals happens to miss a portion of a song, broadcast, show, news story, and/or the like, the listener cannot rewind the signal and play the signal back. Hence, the listener simply must accept that he/she cannot hear the missed portion of the broadcast signal.

In further example and without limitation, tape cassette play, MP-3 play, and CD-sourced play all desirably allow a user to play back a missed portion of a story or song, however, they all also suffer from a substantially similar drawback. That is, each of these modes of operation require a respective form of rewinding the mode of operation, which undesirably forfeits the last heard moment (e.g., note, lyric, word, beat, and/or the like) of the form of entertainment (e.g., a tape cassette requires a user to stop the tape cassette from playing a certain form of entertainment, rewind the cassette to a certain point at which the user missed a portion of the entertainment, and either listen to the entire form of entertainment over again or stop the cassette from playing and fast forward the cassette to the location at which the user originally stopped the cassette). Therefore, the listener oftentimes must spend a relatively long amount of time attempting to hear only a small portion of missed entertainment.

There is therefore a need for a method and an assembly which allows a listener of substantially any desired form of conventional automobile entertainment to selectively listen to a missed portion of the entertainment in a convenient manner. There is also a need for a method and an assembly which allows a listener to easily select which portion of entertainment he/she desires to listen to by one or more depressions of a button. There is still a further need for a method and an assembly which allows a user to selectively listen to a missed portion of the entertainment in a compressed format which eventually and seamlessly transitions from the compressed mode of operation to a non-compressed mode of operation or "normal operation", which overcomes some or all of the previously delineated drawbacks of prior automobile entertainment systems.

SUMMARY OF THE INVENTION

A first non-limiting advantage of the present invention is that it provides an assembly which allows for the selective playback of a desired portion of a broadcast signal or recorded signal in a manner which overcomes the previously delineated drawbacks of prior automobile entertainment assemblies.

A second non-limiting advantage of the invention is that it provides an assembly which allows for the selective playback of a desired portion of a broadcast signal or recorded signal in a manner which overcomes the previously delineated drawbacks of prior automobile entertainment assemblies, and which further allows a user to selectively listen to a desired portion of a broadcast signal or recorded signal in a compressed mode of operation and eventually and seamlessly blend the compressed mode of operation into a non-compressed mode of operation or "normal operation".

A third non-limiting advantage of the present invention is that it provides a method for recording and listening to a portion of automobile entertainment in a compressed mode of operation, which overcomes the drawbacks of prior automobile entertainment re-play methodologies.

A fourth non-limiting advantage of the present invention is that it provides a playback radio assembly which is disposed within a conventional radio. Particularly, the playback radio assembly comprises a first converter assembly which is coupled to the conventional radio, and which receives a certain signal from the conventional radio and converts the received signal; a memory assembly which is coupled to the first converter portion and which records a first amount of the converted signal, erases at least a first portion of the recorded signal from at least one first section of the memory portion, and records at least one second portion of the converted signal in the at least one first section; and a second converter assembly which is coupled to the memory assembly, and which receives the first amount and the at least one second amount of recorded signal from the memory assembly.

A fifth non-limiting advantage of the present invention is that it provides a playback radio assembly which is disposed within a conventional radio. Particularly, the playback radio assembly comprises an analog to digital converter; a digital signal processor which is coupled to the analog to digital converter; a memory assembly which is coupled to the digital signal processor; and a digital to analog converter which is coupled to the digital signal processor.

A sixth non-limiting advantage of the present invention is that it provides a method for replaying a real time audio signal. Particularly, the method comprises the steps of providing an analog to digital converter; providing a digital signal processor and coupling the digital signal processor to the analog to digital converter; providing a memory assembly and coupling the memory assembly to the digital signal processor; providing a digital to analog converter and coupling the digital to analog converter to the digital signal processor; communicating a real time analog audio signal to the analog to digital converter; converting the analog audio signal into a digital audio signal and recording the converted signal in the memory assembly; accessing the recorded signal and compressing the recorded signal; and playing the compressed recorded signal.

These and other features, aspects, and advantages of the present invention will become apparent from a reading of the following detailed description of the preferred embodiment of the invention and by reference to the following drawings.

DETAILED DESCRIPTION OF THE PREFERRED EMBODIMENT OF THE INVENTION

The present invention may be understood more readily by reference to the following detailed description of preferred embodiments of the invention.

Before the present methods and apparatuses are disclosed and described, it is to be understood that the terminology used herein is for the purpose of describing particular embodiments only and is not intended to be limiting. It must be noted that, as used in the specification and the appended claims, the singular forms "a", "an", and "the" include plural referents unless the context clearly dictates otherwise.

Figure 1:
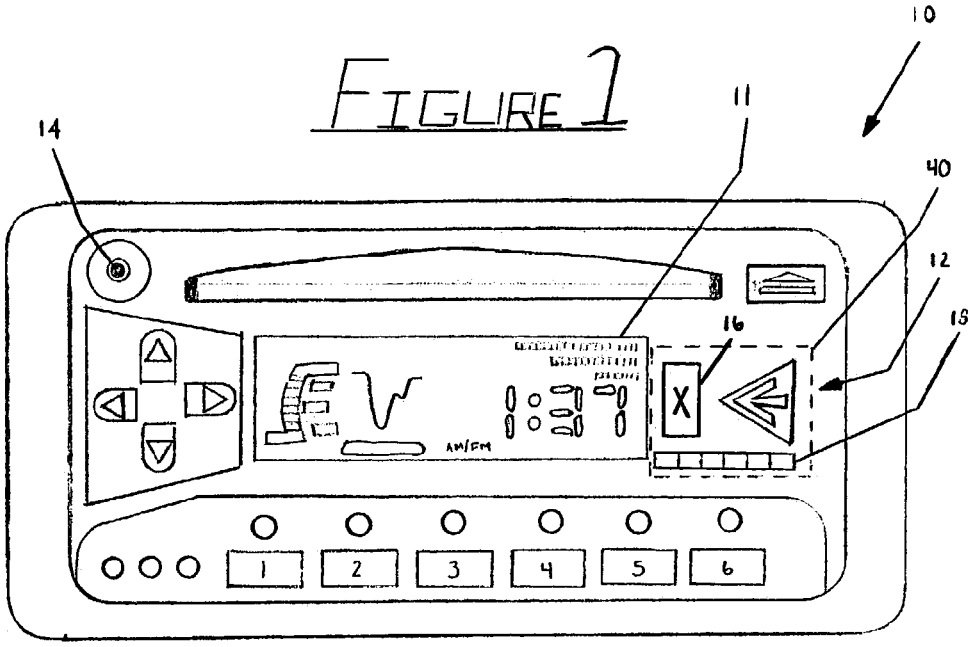
FIG. 1 is a front view of a radio assembly which is made in accordance with the teachings of the preferred-embodiment of the invention.

Referring now to FIG. 1, there is shown a conventional radio 10 and a playback radio assembly 40 which is made in accordance with the teachings of the preferred embodiment of the invention. As shown playback radio assembly 40 includes a selectively depressible replay actuation switch 12 and the conventional radio 10 includes a selectively depressible audio source actuation switch 14 and a display portion 11. At the outset, it should be understood that the radio 10 is substantially similar to a conventional radio assembly with the exception that the radio 10 includes the replay radio assembly 40 (i.e., a replay switch 12 and the components associated with the replay switch 12), as will be discussed further below (i.e., the radio 10 may include a face plate, a housing, programmable functions, and circuitry, wiring, and components which conventionally enable a radio to perform a desired function). That is, the radio 10 also includes conventional features of a conventional radio. For example and without limitation, radio 10 may also include several selections for audio sources (e.g., compact disc player, cassette player, satellite sourced radio, MP-3 player, and/or the like), several depressible switches (e.g., AM/FM selection switch, CD-eject switch; cassette-eject switch, volume control switch, and/or the like, and/or several conventional options (e.g., pre-set or programmable one-touch AM/FM station selection switches, LCD display, pull-off face plate, illuminated switches and display, and/or the like).

It should also be understood that the selectively depressible audio source actuation switch 14; is a conventional audio source selection switch which selectively determines which audio source will be selected from the audio sources which are available (e.g., Compact Disc player, AM/FM/Satellite radio, cassette player, MP-3 player, and/or the like).

In one non-limiting embodiment of the invention, the playback radio assembly 40 may include a selectively depressible termination switch 16 which allows a user to terminate an actuated replay function, as will be discussed further below and with reference to FIGS. 2–4 (i.e., once a user has selectively depressed the switch 12, effective to actuate the replay function, a user may selectively depress the switch 16 in order to terminate the replay function). It should be appreciated that, in this non-limiting embodiment, the termination switch may be selectively depressed at any point during the replay function, effective to terminate the replay function (e.g., if the user has listened to the desired replay and desires to listen to the current incoming audio, the user may terminate the playback function and immediately resume listening to the current incoming audio stream).

It yet another non-limiting embodiment of the present invention, the playback radio assembly 40 may include a selectively illuminatable portion 18 which illuminates in response to a certain number of depressions of the switch 12. That is, the portion 18 may illuminate a first amount or illuminate fully in a first color in response to one depression of the switch 12, whereas a second depression of the switch 12 may cause the portion 18 to illuminate a second amount or illuminate fully in a second color. It should be understood that subsequent depressions of the switch 12 may also cause the portion 18 to illuminate in an amount which is proportionate to the number of depressions or to illuminate in a color which is associated with the number of depressions, and which is different than the first and second colors resultant from the first and second depressions of the switch 12.

It should also be appreciated that the selectively illuminatable portion 18 may change colors, illuminate less, illuminate more, and/or the like dependent upon the depressions of the switch 12. That is, a depression of the switch 12 actuates the playback function which, as will be discussed further below, plays a predetermined amount of previously recorded material in a compressed format, such that the "replayed" material eventually matches up with the current material and, the illuminatable portion 18 may selectively change in response to an amount of material which is being replayed, an amount of material which has not yet been replayed, an amount of material which is left to be replayed until the replay function terminates, and/or the like. In other non-limiting embodiments, a counter may be incorporated into a display, such as display 11, which displays the amount of depressions which the switch 12 has received, displays the amount of replay left to play before the playback function terminates, and/or the like.

Figure 2:
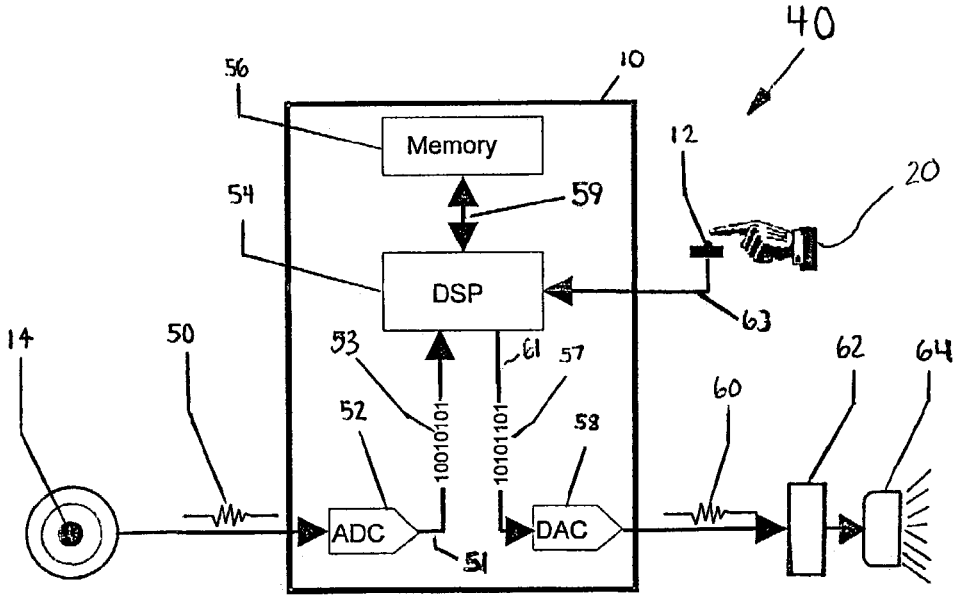
FIG. 2 is a schematic display of a portion of the radio assembly.

Referring now to FIG. 2, there is shown a schematic diagram of the playback radio assembly 40 which is disposed within the radio 10. As shown, assembly 40 includes an analog to digital converter 52, a digital signal processor 54, memory 56, a digital to analog converter 58, an amplifier 62, and at least one speaker assembly 64. Particularly, upon a selective depression of the audio source actuation switch 14, a user sources a selective analog audio signal 50 to the analog to digital converter 52 and, in a well known and conventional manner, the analog to digital converter 52 converts the analog audio signal 50 into a digital representation or digital signal 53 of the analog audio signal 50. That is, as should be understood by one who is skilled in the relevant art, conventional digital to analog converters, such as and without limitation, analog to digital converter 52 may perform the conversion process in a three-step process. The first step of this three-step process is commonly known as "sampling" and, in this first step, analog to digital converter 52 performs a conversion of a continuous-time signal (e.g., audio, video, sonar, speech, seismic, and the like) into a discrete-time signal by taking samples of the continuous-time signal at discrete-time instants. The second step of this three-step process is commonly known as "quantization" and, in this second step, a conversion of a discrete-time continuous-valued signal into a discrete-time discrete-valued digital signal is performed. The value of each of the signal samples are represented by a value chosen from a finite set of possible values and, the difference between the unquantized sample and the quantized sample is commonly referred to as "quantization error". The final step of this three-step process is commonly known as "coding" and, in this final step, each discrete value is represented by a b-bit binary sequence (e.g., a compilation of b-bit binary sequences comprises ones and zeros in a set stream which digitally represents a converted audio signal and which is easily read and/or processed by a computer, processor, and/or the like).

The analog to digital converter 52 then communicates the digital representation 53 (i.e., the binary code stream) of the analog audio signal 50 to a digital signal processor 54 (i.e., the output of the digital to analog converter 52 is a digital signal that is appropriate as an input to the digital signal processor 54) via bus 51.

It should be understood by one who is skilled in the relevant art that the process of converting an analog signal, such as and without limitation, signal 50 to a digital signal, such as and without limitation, representation or digital signal 53, may yield numerous errors (e.g., quantization error) or inconsistencies (i.e., the digital representation 53 of the analog signal 50 may not exactly match or "mirror" the analog signal 50). These errors may be significantly reduced by software or programming which may be resident within or remote from a digital signal processor, such as and without limitation, digital signal processor 54. That is, as with most programmable systems, various accuracy requirements may be selectively programmed into the system in order to effectuate a desired result. Such requirements, in turn, result in specifying the accuracy requirements in the analog to digital converter 52 and the digital signal processor 54, in terms of word length, floating-point versus fixed-point arithmetic, and the like. It should also be understood that the digital signal processor 54 may also include a conventional compression algorithm which is operable under stored program control, and which digitally compresses an incoming digital signal, such as signal 53 or signal 57, by a predetermined percentage factor, such as and without limitation, ten percent.

The digital signal processor 54 then communicates the reduced error signal or "clean" signal to the memory assembly 56 via bus 59, which removably records the clean signal onto a magnetic storage device or "magnetic media", random access memory or "RAM", and/or substantially any desired conventional or commercially available memory device, such as and without limitation, a tape, disk, RAM, and/or the like. That is, as will be discussed in greater detail below, digital signals are easily stored on magnetic media and RAM without deterioration or loss of signal fidelity (i.e., errors) beyond that which are introduced in the analog to digital conversion.

In one non-limiting embodiment of the invention, the digital signal processor 54 may cooperate with other conventional programming, hardware, and/or the like to process, compress, remove errors, and/or the like. For example and without limitation, the digital signal processor 54 may comprise a Texas Instruments model TMS320C6000 digital signal processor having a multi-channel buffered serial port and, may be used in conjunction with a TLV320AC56 voice band audio processor, although other conventional and commercially available components, digital signal processors, voice band processors, conventional programming, and/or the like may also be employed in conjunction with or substituted for one or more of the abovementioned components.

As will be discussed in greater detail below, the digital representation or signal 53 is then "retrieved" by or communicated back to the digital signal processor 54 from the memory 56 via bus 59. DSP 54 then communicates a substantially similar signal or representation 57 of the audio signal 50, via bus 61, to a digital to analog converter 58 (i.e., the signal 57 is substantially; similar to the signal 53 with the exception that the signal 57 has been processed by the digital signal processor 54, thereby substantially reducing various errors which may have been resident within the signal 53). The digital to analog converter 58 then performs a conversion of the digital signal 57 to an audio signal 60.

It should be appreciated that there are pluralities of processes which the digital to analog converter 58 may perform to accomplish the digital to analog conversion. For example and without limitation, the digital to analog conversion may be effectuated through a zero-order hold or a staircase approximation, linear interpolation (i.e., linearly connecting a pair of successive samples), quadratic interpolation (i.e., fitting a quadratic through three successive samples), and/or the like. Therefore, nothing within this description is meant to limit the process of digital to analog conversion to just one particular conversion process. Rather, substantially any desired conversion process may be selectively programmed into the digital to analog converter 58.

Figure 3:
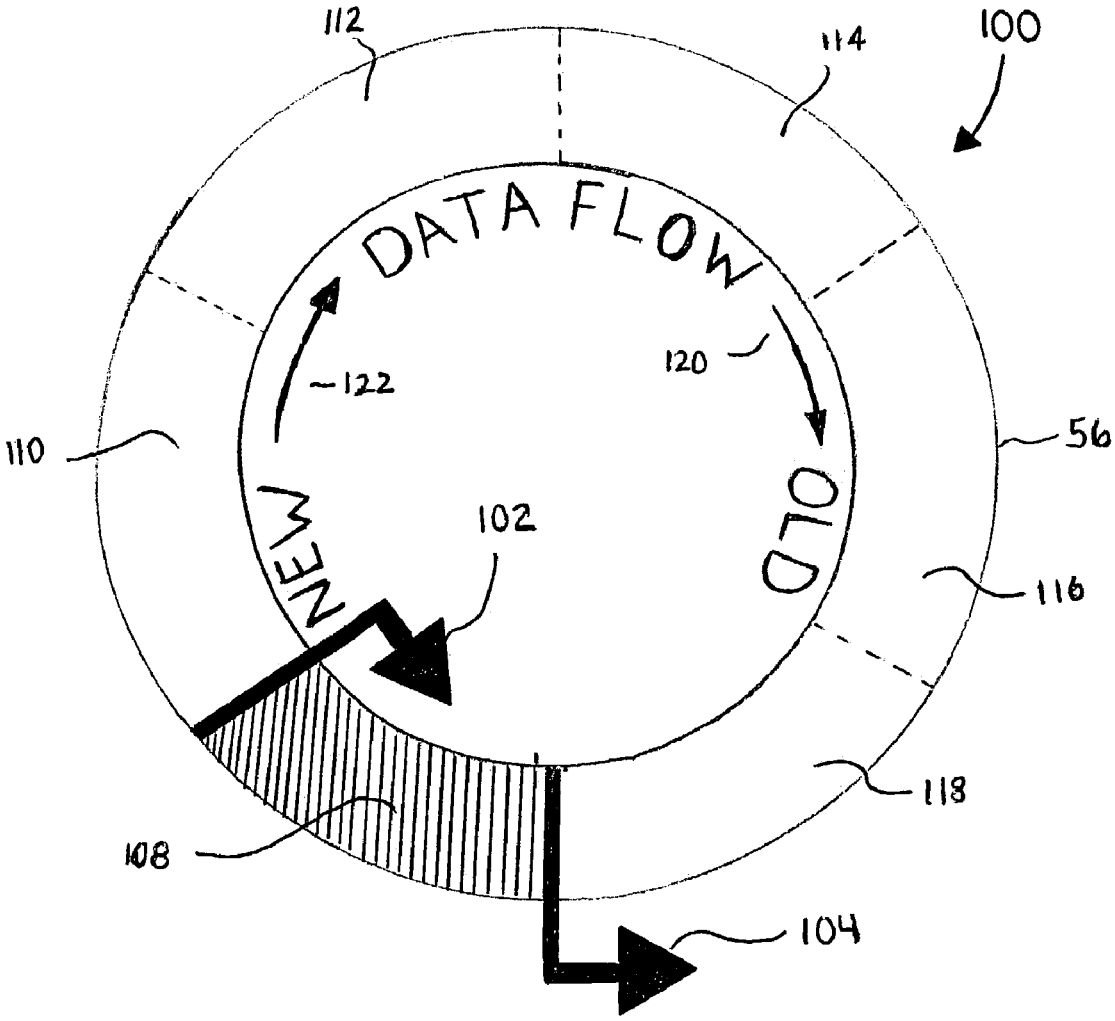
FIG. 3 is a diagrammatic representation of a portion of the radio assembly which is shown in FIGS. 1–2.

Referring now to FIG. 3, there is: shown a diagrammatic representation 100 of a ring buffer memory 56 which is made in accordance with the teachings of the preferred embodiment of the invention. It should be understood that the ring: buffer memory 56 is a storage device which continually records digitally converted analog signals while concomitantly and continually erasing or deleting the oldest recorded signals to make room for the incoming digitally converted analog signals. In the preferred embodiment of the invention, the ring buffer memory 56 provides a predetermined amount of memory, such as and without limitation, sixty seconds (e.g., the ring buffer memory 56 will be capable of recording the latest sixty seconds of a selected, signal). That is, the ring buffer memory 56 initially records sixty seconds of digitally converted analog signal, then the ring buffer memory 56 erases the very first second of signal which was recorded while concomitantly updating or appending the memory with the latest one second of incoming signal and repeats this constant erasing and recording process until such time that the user 20 selectively interrupts the power being sourced to the radio 10 (e.g., the user 20 may turn off the radio: 10 or turn off the ignition switch of the vehicle in which the radio 10 may be disposed). In one non-limiting embodiment of the invention, the playback radio assembly 40 may include a "radio-off"function (not shown) which selectively allows the memory 56 to record the 20, digitally-converted analog signal even when the radio 10 is off or the vehicle in which the radio 10 is disposed has been turned off (e.g., the vehicles ignition has been selectively turned off). It should be appreciated that this radio-off function may be directly coupled to the battery (not shown) of the vehicle (not shown) in which the radio 10 is disposed, thereby providing the radio 10 with a substantially constant source of electrical energy, thereby allowing the ring buffer memory 56 to function even if the vehicle has been "turned off". It should also be appreciated that, in this non-limiting embodiment, the radio-off function may also include a standby mode that would be activated when either the vehicle key is switched off and/or the radio power is switched off allowing the continuation of the digitally-converted signal to be stored. This would allow the immediate recall and review of audio data that had occurred prior to the vehicle ignition power and/or the radio front panel power being applied.

It should also be appreciated that, in this non-limiting embodiment, the radio-off function may, also include timed, termination programming, a sensor. (e.g., voltage sensor, and/or the like), or a timer which determines when the radio-off function is to be terminated.

As best shown in FIG. 3, memory 56 includes a plurality of memory sections 108, 110, 112, 114, 116, 118 respectively, which, in one non-limiting embodiment, are each capable of recording ten seconds of digitally converted analog signals (e.g., as shown in FIG. 3, the memory 56 would have a maximum capacity of sixty seconds of recorded digitally-converted analog signal). Furthermore, the memory 56 includes a recording point 104 in the buffer memory 56 where a signal, such as signal 53 enters the memory 56 and is temporarily stored or recorded. It should be understood that the recording of the ring buffer memory 56 is conducted in the direction of arrows 120 and 122 (i.e., recording is conducted in a clockwise direction beginning with the recording point 104 and rotationally ending at the same recording point 104). That is, recording is performed at the point 104 (i.e., recording point 104 is the point where all new information or digitally converted signals enter the ring buffer 56) and continues through the first section 108, through the second section 110, through the third section 112, through the fourth section 114, through the fifth section 116, and through the sixth section 118. Once the first section 108 has been filled with recorded digital signal data, the second section 110 is then filled with recorded digital signal data. Once the second section 110 has been filled with recorded digital signal data, the third section 112 is then filled with recorded digital signal data. Once the third section 112 has been filled with recorded digital signal data, the fourth section 114 is then filled with recorded digital signal data. Once the fourth section 114 has been filled with recorded digital signal data, the fifth section 116 is then filled with recorded digital signal data. Once the fifth section 116 has been filled with recorded digital signal data, the sixth section 118 is then filled with recorded digital signal data (i.e., the latest one second of recorded signal "pushes" the second latest one second of recorded signal data towards the sixth section 118).

As point 104 is the only location where new data is input into memory 56, all information subsequently received into memory 56 displaces or "pushes" the previously recorded data through the ring memory 56 until memory 56 is "full". In this manner, after the ring memory 56 is full of recorded and digitally converted analog signal, the oldest or first amount of information which was initially recorded has been pushed around the ring memory 56 until it is located next to the recording point 104 and within the sixth section 118.

After all of the sections 108–118 are filled with recorded digital signal data, the oldest one second of recorded signal from the sixth section 118 is erased. This erasing of the oldest one second of recorded signal data provides one second of room or memory space at the point 104 and within the first section 108. Hence, upon all sections 108–118 of the memory 56 being filled with recorded digitally converted analog signal data, the oldest one second of recorded signal (i.e., the signal data which is located in the sixth section 118 and next to the point 104) is erased while the newest or current real time digitally converted analog signal data is concomitantly recorded. In this manner, the memory 56, at any point in time (i.e., any point in time after the entire memory 56 has first been filled), will only contain or hold the most recent sixty seconds of recorded digitally converted analog signal. It should be understood that the memory type and the manipulation of the memory is not limited to the memory type and manipulation which is described above. Rather, as should be appreciated, the memory type and manipulation of the memory type may be substantially any desired type of memory or substantially any desired type of manipulation of the memory.

Figure 4:
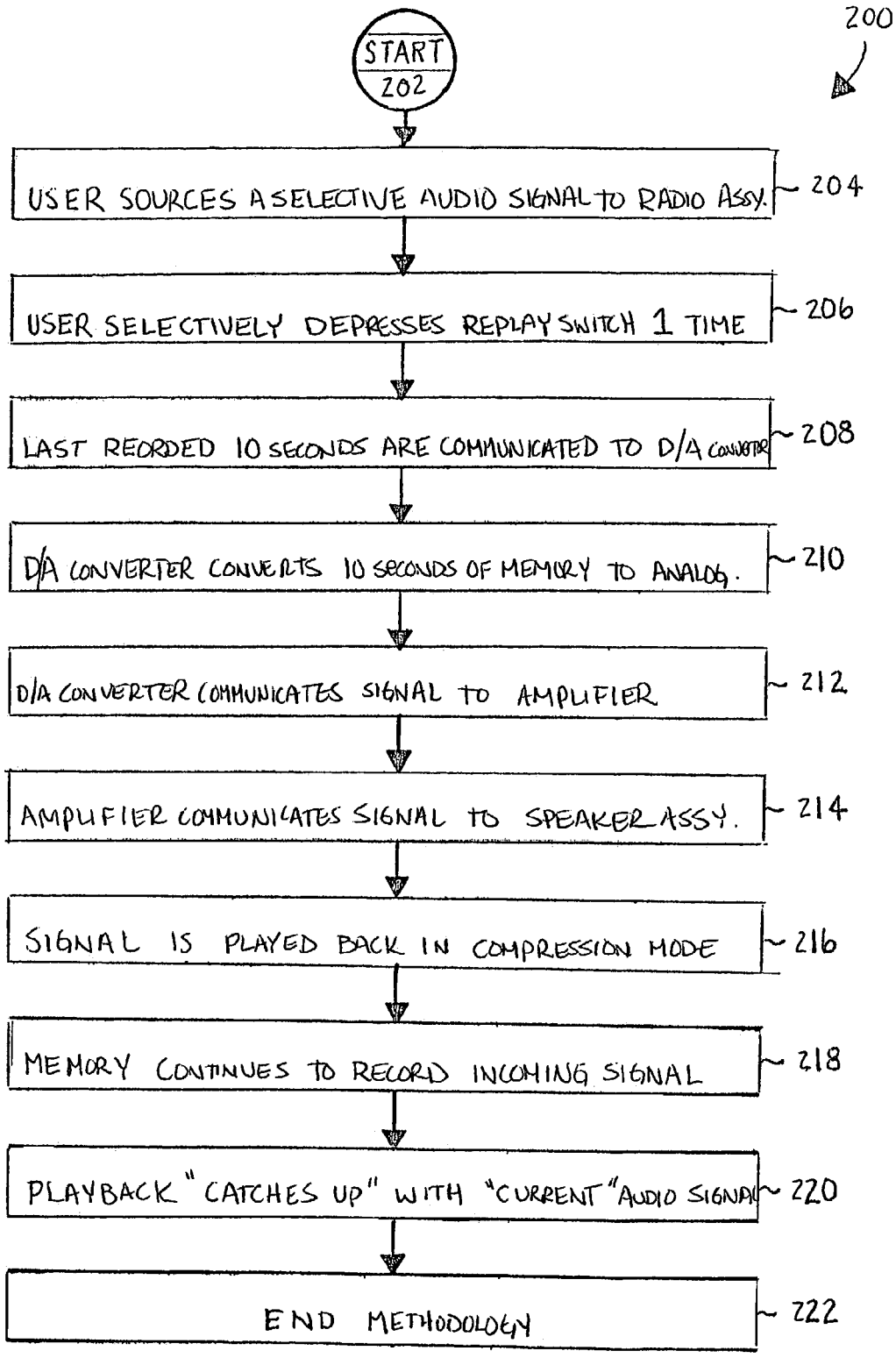
FIG. 4 is a flow chart depicting a methodology which is conducted in accordance with the teachings of the preferred embodiment of the invention.

As best shown in FIGS. 3 and 4, there is shown a methodology 200 for replaying a recorded and compressed audio signal which is performed in accordance with the teachings of the preferred embodiment of the invention. As shown, the methodology begins with the step 202 and, in this step 202, the methodology 200 is started. Step 204 follows step-202 and, in this step 204, the user 20; selectively depresses the switch 14 of the radio 10, effective to select a particular audio source (e.g., AM/FM/satellite radio, Compact Disc player, Cassette player, MP-3 player, and/or the like). Step 206 follows step 204 and, in this step 206 a user 20 has selectively depressed the selectively depressible switch 12 one time (i.e., one depression of the switch 12) which has activated the "playback" function of the playback radio assembly 40 to playback the latest ten seconds of recorded digitally converted analog signal.

It should be appreciated that, although the preceding and foregoing description of methodology 200 only refers to one selective depression of the switch 12, the capabilities and capacity of the ring buffer memory 56 is not limited to solely one such depression of the switch 12. Rather, as discussed above, the preferred embodiment of the ring buffer memory 56 is capable of at least six such depressions of the playback switch 12, thereby allowing for a full one minute or sixty seconds of selective playback in a compressed format. The description of the methodology 200 includes only one depression of the playback switch 12 merely for illustrative purposes only, therefore nothing within this description should be construed as limiting the playback switch 12 to any particular number of selective depressions or the capacity of the ring buffer memory 56.

Furthermore, it should be understood that, although; the preferred embodiment of the ring buffer memory 56 is limited to only one minute or sixty seconds of playback memory at one time, nothing within this description is meant to limit the memory 56 to only sixty seconds. Rather, as should be appreciated by one who is skilled in the relevant art, the ring buffer memory 56 which is employed in the playback radio assembly 40 may be of substantially any desired size and any desired capacity (e.g., rather than a sixty second capacity, the memory may have the ability to record up to five minutes, twenty minutes, one-half hour, one hour, and/or the like).

Step 208 follows step 206 and, in this step 208, the ten seconds of recorded material immediately preceding the one depression of the switch 12 is communicated to the digital signal processor 54 where, in one non-limiting embodiment of the invention, the digital signal of the latest ten seconds of recorded material is compressed by ten percent. Also, in this step 208, the ten seconds of recorded material, along with the material which is continually recorded by the memory 56 is communicated to the digital to analog converter 58. That is, the digital to analog converter 58 receives the latest ten seconds of recorded material from; the memory 56, as well as the newly recorded and continually appended digitally converted analog signal (e.g., the latest ten seconds of memory and a predetermined amount of recorded material following the latest ten seconds of recorded material is compressed by ten percent and communicated to the digital to analog converter 58 until such time that the compressed material matches up with the current or "real time" signal, thereby allowing a user 20 to listen to at least ten seconds of past audio without missing any of the current or real time broadcast signal which occurs during the replay time period).

Step 210 follows step 208 and, in this step 210, the latest ten second of recorded material and the predetermined amount of material which immediately follows the latest ten seconds of recorded material is converted from a digital signal to an analog signal. Step 212 follows step 210 and, in this step 212, the converted signal: is communicated from the digital to analog converter 58 to an amplifier assembly 62, which amplifies the signal (e.g., signal 60). Step 214 follows step 212 and, in this step 214, the amplifier communicates the amplified signal to the speaker assembly 64, where the compressed analog signal may be heard.

Step 216 follows step 214 and, in this step 216, the entirety of the latest ten seconds of recorded material and the predetermined amount of material immediately following material are listened to by a user 20 in a compressed format (i.e., in the preferred embodiment, the playback of the aforementioned material is executed at one hundred and ten percent or ten percent faster than a received real time signal). Step 218 follows step 216 and, in this step 218, the memory 56 continues to record all of the most recent incoming signals or material from the source of audio which was previously selected by the user 20 in the step 204. Step 220 follows step 218 and, in this step 220 the playback function (i.e., the latest ten seconds and the immediately following material) catches up to the real time signal and terminates the one hundred and ten percent playback speed, effective to blend the compressed material into the incoming and real time material or signal in a substantially "seamless" manner. Step 222 follows step 220 and, in this step 222, the methodology 200 had ended.

For example and without limitation, a user 20 may be listening to an "on-air broadcast" radio show and receive a cellular telephone call that lasts fifty eight seconds. The user 20 may have missed approximately the last one minute of the on-air broadcast radio show. At this time the user 20 may selectively depress the playback switch 12 six times in order to replay the latest one minute or sixty seconds of "missed" on-air broadcast signal in a compressed format. That is, six depressions of the playback switch 12 would actually cause the playback radio assembly 40 and the radio 10 to output or "play" compressed audio for a period of three-hundred and twenty four seconds (i.e., five minutes and twenty four seconds). After the five minute and twenty four second playback is complete, the audio stream which the user 20 is listening to would be "in sync" with the on-air broadcast. At this time, the audio output of the playback radio assembly 40 and the radio 10 would revert to a non-compressed mode (i.e., the playback radio assembly 40 would continue to append digital audio data to the memory 56 but the user would hear the real time on-air radio broadcast in a non-compressed format until such time that the user, again, selectively depresses the playback switch 12).

In one non-limiting embodiment of the invention, switch 12 may be adapted to receive an extended duration depression which would effectuate a "full" playback response. That is, rather than the switch 12 requiring six individual "short" duration depressions to playback sixty seconds of the most recently acquired digitally converted analog signal, a user 20 may selectively, depress and hold the switch 12 for a predetermined amount of time (e.g., approximately one to three seconds), effective to automatically "cue-up" or play the sixty seconds of the most recently acquired digitally converted analog signal.

It should be understood that this invention is not limited to the exact construction or embodiments listed and described, but that various changes may be made without departing from the spirit and scope of the invention.

What is claimed is:

1. A playback radio assembly which is disposed within a conventional radio, said playback radio assembly comprising:

a first converter assembly which is coupled to said conventional radio, and which receives a certain signal from said conventional radio and converts said received signal;

a memory assembly which is coupled to said first converter portion and which records a first amount of said converted signal, erases at least a first portion of said recorded signal from at least one first section of said memory portion, and records at least one second portion of said converted signal in said at least one first section; and a second converter assembly which is coupled to said memory assembly, and which receives said first amount and said at least one second amount of recorded signal from said memory assembly, wherein said first converter assembly comprises an analog to digital converter, wherein said memory assembly comprises a ring buffer memory having a first section, a second section, a third section, a fourth section, a fifth section, and at least a sixth section, wherein each of said sections are capable of recording a certain respective and predetermined amount of audio signal, wherein said certain respective and predetermined amount of audio signal comprises ten seconds of audio signal, wherein said second converter assembly comprises a digital to analog converter, further comprising a digital signal processor which is communicatively coupled to said analog to digital converter, said memory, and said digital to analog converter, said digital signal processor being adapted to compress said recorded first amount and said recorded at least one second amount of said converted signal by a certain percentage, wherein said certain percentage comprises ten percent, wherein said first certain signal comprises a non-compressed real time audio signal, said playback radio assembly further including a selectively depressible actuation switch which is coupled to said conventional radio and to said playback radio assembly, wherein a first depression of said actuation switch activates said playback radio assembly and communicates said recorded audio signal from said first section of said memory to said digital signal processor, effective to replay said recorded audio signal from said first section in a compressed format while said memory continues to record said real time audio signal and said digital signal processor concomitantly compresses said real time audio signal and said conventional radio plays said real time audio signal in a compressed format until such time that said compressed real time audio signal becomes in sync with said non-compressed real time audio signal.

2. A method for replaying a real time audio signal, said method comprising the steps of:

providing an analog to digital converter;

providing a digital signal processor and coupling said digital signal processor to said analog to digital converter;

providing a memory assembly and coupling said memory assembly to said digital signal processor;

providing a digital to analog converter and coupling said digital to analog converter to said digital signal processor;

communicating a real time analog audio signal to said analog to digital converter;

converting said analog audio signal into a digital audio signal and recording said converted signal in said memory assembly;

accessing said recorded signal and compressing said recorded signal; and playing said compressed recorded signal wherein said step of providing a digital signal processor and coupling said digital signal processor to said analog to digital converter further comprises the steps of:

providing at least one compression algorithm; and programming said digital signal processor with said compression algorithm, wherein said step of providing a memory assembly and coupling said memory assembly to said digital signal processor further comprises the steps of:

sectioning said memory assembly into at least six memory sections;

causing a sixth of said at least six memory sections to contain an oldest portion of said recorded signal;

causing a first of said at least six memory sections to contain a newest portion of said recorded signal;

causing said first of said at least six memory sections to record a new portion of said converted analog audio signal while concomitantly causing said sixth of said at least six memory sections to erase an old portion of said converted analog audio signal.

3. The method of claim 2 wherein said step of accessing said recorded signal and compressing said recorded signal further comprises the steps of:

providing a conventional, radio;

disposing said digital to analog converter, said memory assembly, said digital signal processor, and said digital to analog converter within said conventional radio;

providing a selectively depressible playback actuation switch;

communicatively coupling said playback actuation switch to said memory assembly, said digital signal processor, and said digital to analog converter; and adapting said digital signal processor to access a respective predetermined amount of memory upon each selective depression of said selectively depressible playback actuation switch.

4. The method of claim 3 wherein said step of providing at least one compression algorithm further comprises the step of providing a compression algorithm which compresses said recorded signal by ten percent.

* * * * *